US007406763B2

(12) United States Patent
Hirata et al.

(10) Patent No.: US 7,406,763 B2
(45) Date of Patent: Aug. 5, 2008

(54) METHOD OF PRODUCING MULTICONDUCTOR CABLE HARNESS

(75) Inventors: Hisashi Hirata, Tochigi (JP); Shizuyoshi Satou, Tochigi (JP); Hiroyuki Senba, Tochigi (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/498,133

(22) Filed: Aug. 3, 2006

(65) Prior Publication Data

US 2006/0266541 A1 Nov. 30, 2006

Related U.S. Application Data

(62) Division of application No. 11/058,415, filed on Feb. 16, 2005, now Pat. No. 7,098,404.

(30) Foreign Application Priority Data

Feb. 23, 2004 (JP) ..... 2004-046375

(51) Int. Cl.
*H01R 43/00* (2006.01)

(52) U.S. Cl. ..... 29/857; 29/33 F; 29/759; 29/760; 29/868; 156/53; 174/72 A

(58) Field of Classification Search ..... 29/33 F, 29/33 M, 745, 749, 759, 760, 825, 857, 868; 156/52–56, 167; 174/71 R, 72 A, 77 R, 117 F
See application file for complete search history.

(56) References Cited

U.S. PATENT DOCUMENTS 3,881,976 A * 5/1975 Jones ..... 156/167
4,723,055 A * 2/1988 Bisker ..... 174/77 R
4,874,908 A 10/1989 Johansson ..... 174/72 A
5,010,642 A * 4/1991 Takahashi et al. ..... 29/868
6,230,404 B1 * 5/2001 Nakamura et al. ..... 29/857
6,748,990 B2 6/2004 Ashima et al. ..... 156/358

FOREIGN PATENT DOCUMENTS

CH 280 298 A 1/1952
FR 1 544 150 A 10/1968

(Continued)

OTHER PUBLICATIONS

Japanese Office Action for corresponding Japanese Application dispatched Feb. 14, 2006.

*Primary Examiner*—Donghai D. Nguyen
(74) *Attorney, Agent, or Firm*—McDermott Will & Emery LLP

(57) ABSTRACT

A method of producing a multiconductor cable is provided herein. A plurality of wires are arranged in a flat array with a specific pitch at both ends of them having an intermediate portion that are bundled together and a transforming portion. The plurality of wires have lengths different from one another, where the lengths vary successively from the minimum length, Ls, to the maximum length, Lm. At both end portions, the transforming portion of the wires are arranged using an arranging tool and attached so that the wires are held in grooves. The wires are moved from the arranging tool and a terminal structure is formed for electrical connection at both ends of the multiconductor cable.

3 Claims, 7 Drawing Sheets

FOREIGN PATENT DOCUMENTS

| | | | |
|---|---|---|---|
| FR | 2 111 979 | A | 9/1972 |
| FR | 2 266 430 | A | 10/1975 |
| JP | 61-230208 | | 1/1986 |
| JP | 62-271309 | | 11/1987 |
| JP | 6-223645 | | 8/1994 |
| JP | 9-35540 | | 2/1997 |
| JP | 9-282946 | | 10/1997 |
| JP | 2000-294045 | | 10/2000 |

* cited by examiner

METHOD OF PRODUCING MULTICONDUCTOR CABLE HARNESS

RELATED APPLICATIONS

This application is a divisional application of Ser. No. 11/058,415, filed Feb. 16, 2005, now U.S. Pat. No. 7,098,404, which claims priority of Japanese Patent application No. 2004-046375, filed Feb. 23, 2004, the contents of which are herewith incorporated by reference.

BACKGROUND OF THE INVENTION

1. Field of the Invention

The present invention relates to a multiconductor cable incorporating a plurality of insulated wires, coaxial conductors, or the like and a method of producing the multiconductor cable, particularly to a multiconductor cable in which a plurality of wires and conductors are tied together in a bundle at the intermediate portion and are arranged in a flat array at both ends, where the cable is provided with connectors or similar components, and a method of producing the multiconductor cable.

2. Description of the Background Art

As information communications devices, such as notebook-size computers, cellular mobile phones, and video cameras, have been widely used in recent years, they are required to reduce their size and weight. Consequently, connection between the main body of a device and a liquid crystal display and wiring in a device are made using extremely fine insulated wires and shielded wires including coaxial conductors. In addition, a multiconductor cable in which the foregoing wires and conductors are bound together is also used be cause it facilitates the wiring. A multiconductor cable is electrically connected through a connector having the shape of a card-edge connector in which a multitude of contacts are arranged in a row (such a connector is used for the connection of a printed circuit, for example).

FIG. 6A is a plan view of an example of the conventional multiconductor cable, and FIG. 6B is a plan view of another example of the conventional multiconductor cable. In many cases, a multiconductor cable 1*a* provided with connectors as shown in FIG. 6A is used, in which a plurality of electric wires 2 are arranged in parallel with a constant pitch to form a unified structure as a multiconductor cable. The cable 1*a* is suitable for the wiring along the inside wall of a device. However, when it is used for the wiring through a hinged portion, such as the connection between the main body and a liquid crystal display of a cellular mobile phone, its twisting property is insufficient at the hinged portion. In particular, when the size of the hinged portion is small, the stress applied to the cable 1*a* is large and, consequently, the cable tends to suffer a break. Therefore, this type of cable is not suitable for use at a small-hinged portion.

To solve this problem, the wiring through a turning portion, such as a hinged portion for an opening-and-closing operation, is made using a multiconductor cable 1*b* provided with connectors as shown in FIG. 6B. In this cable, both ends to which electrical connectors 3 are connected have a structure in which a plurality of wires 2 are arranged in a flat array and the intermediate portion has a structure in which the wires 2 are bundled together. In this case, the cable 1*b* may be produced such that only both ends have a flat shape and the intermediate portion is formed by bundling the intermediate portions of a plurality of disorganized wires. The cable 1*b* may also be produced by rolling up the intermediate portion of a plurality of wires that arranged in a flat array throughout the length. A plurality of wires 2 are bundled using a bundling member 4 having the shape of a tape. When the wires 2 are coaxial conductors or shielded wires, an intermediate portion of the multiconductor cable is sometimes provided with a grounding member 5 for connecting that portion to the ground.

In the multiconductor cable 1*b* composed of a plurality of wires 2 having the same length, wires placed in the middle position of a flat array are slackened and wires placed at the outside positions are pulled. As a result, the wires placed at the outside positions tend to break. To overcome this problem, the published Japanese patent applications Tokukoushou 61-230208 and Tokukai 2000-294045 have disclosed a multiconductor cable having a specific structure (see FIG. 4 of Tokukai 2000-294045). In this structure, a wire placed at an outer position has a length longer than that of a wire placed at an inner position so that the slack and tension can be prevented.

However, no disclosure has been made about the length of a wire placed at an outer position. No clarification is made for the case that undergoes twisting. In practical application, when a multiconductor cable provided with connectors has a length of E and a width of D and the length E is at least six times the width D, it is confirmed that the intermediate portions of the wires constituting the multiconductor cable and having the shape shown in FIG. 6A can be simply bundled to obtain the shape shown in FIG. 6B without any problem in use.

However, if the length E is small to the extent that the ratio E/D is less than six, a problem is caused due to the difference in length between the minimum length of the wire placed at the center of the bundle and the maximum length of the wire placed at the outermost position of the bundle. More specifically, at the time of bundling a plurality of wires arranged in a flat array, even when the length of wires to be placed at the outer side and to undergo tension is simply increased, a wire having an excess length tends to buckle or break. In addition, for the use in a turning portion, if no consideration is given to the twisting, a break of wire cannot be prevented, that is, the problem cannot be totally solved.

SUMMARY OF THE INVENTION

An object of the present invention is to offer a multiconductor cable that is reduced in the possibility of break even for use at a place where the cable undergoes twisting and a method capable of producing the multiconductor cable easily at a low cost.

To attain the foregoing object, the present invention offers a multiconductor cable that incorporates a plurality of wires that:

(a) are arranged in a flat array with a specific pitch at both ends of them;

(b) have an intermediate portion at which they are bundled together; and (c) have lengths different from one another, the lengths varying successively from the minimum length, Ls, to the maximum length, Lm. The multiconductor cable satisfies the following formulae:

$$D/E>1/6, \text{ and } (Lm-Ls)>\{(D^2+E^2)^{1/2}-E\},$$

where D is the width of the cable at both ends, E is the distance between the ends of the cable, Lm is the maximum length, and Ls is the minimum length.

The multiconductor cable may satisfy the following formulae:

$$\theta<45 \text{ degrees, and } (Lm-Ls)<3\times\{2D(2^{1/2}-1)\}\approx 2.5D,$$

where θ is the angle produced by a wire's portion from one of the ends to the intermediate portion and the same wire's portion in the intermediate portion, Lm is the maximum length, Ls is the minimum length, and D is the width of the cable at both ends. In the multiconductor cable, the wire placed at the center of the array of the wires may have the minimum length. In the multiconductor cable, the wire placed at one of the outermost positions of the array of the wires may have the minimum length. The multiconductor cable may be intended to use at a place where it undergoes twisting with a twisting angle of 80 to 190 degrees.

According to one aspect of the present invention, the present invention offers a method of producing at least one multiconductor cable that incorporates a plurality of wires that:

(a) are arranged in a flat array with a specific pitch at both ends of them; and (b) are bundled together at an intermediate portion. The method includes the following steps:

(c) the preparing of an arranging tool provided with at least one wire-holding-groove-forming portion having a plurality of wire-holding grooves with different lengths from a minimum length of Lsa to a maximum length of Lma, the lengths being varied successively. In the arranging tool, the at least one wire-holding-groove-forming portion is provided with at both end portions a transforming-portion-arranging section for arranging a transforming portion of the wires. In the above description, the transforming portion is a portion located between each of the ends and the intermediate portion;

(d) the arranging of a plurality of wires using the arranging tool;

(e) the attaching of an adhesive tape or a member having a similar function to the transforming portions of the wires so that the arranged state can be maintained;

(f) the removing of the wires from the arranging tool with maintaining the arranged state;

(g) the forming of a terminal structure for electrical connection at both ends; and (h) the bundling of the intermediate portions of the wires together.

In the arranging tool, the at least one wire-holding-groove-forming portion may satisfy the following formulae:

$$Da/Ea>1/6, \text{ and } (Lma-Lsa)>\{(Da^2+Ea^2)^{1/2}-Ea\},$$

where Da is the arranging width of the transforming-portion-arranging section, and Ea is the effective length of the at least one wire-holding-groove-forming portion. The method may use the arranging tool in which the at least one wire-holding-groove-forming portion is at least two wire-holding-groove-forming portions connected in tandem. In this description, the or each wire-holding-groove-forming portion is provided for forming one multiconductor cable.

Advantages of the present invention will become apparent from the following detailed description, which illustrates the best mode contemplated to carry out the invention. The invention can also be carried out by different embodiments, and its several details can be modified in various respects, all without departing from the invention. Accordingly, the accompanying drawing and the following description are illustrative in nature, not restrictive.

BRIEF DESCRIPTION OF THE DRAWING

The present invention is illustrated to show examples, not to show limitations, in the figures of the accompanying drawing. In the drawing, the same reference numeral and sign refer to a similar element. In the drawing:

FIG. 6 is a perspective view of another example of an arranging tool for producing a multiconductor cable in the first embodiment of the present invention.

DETAILED DESCRIPTION OF THE INVENTION

Figure 1A:
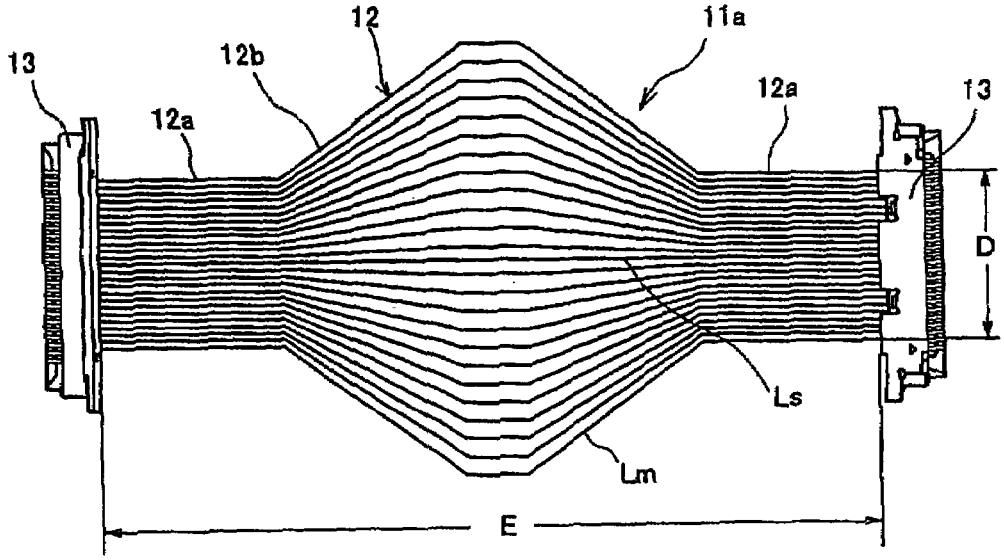
FIG. 1A is a plan view of a multiconductor cable in a first embodiment of the present invention, the view showing a state in which the intermediate portions of the wires constituting the cable are not bundled.
Figure 1B:
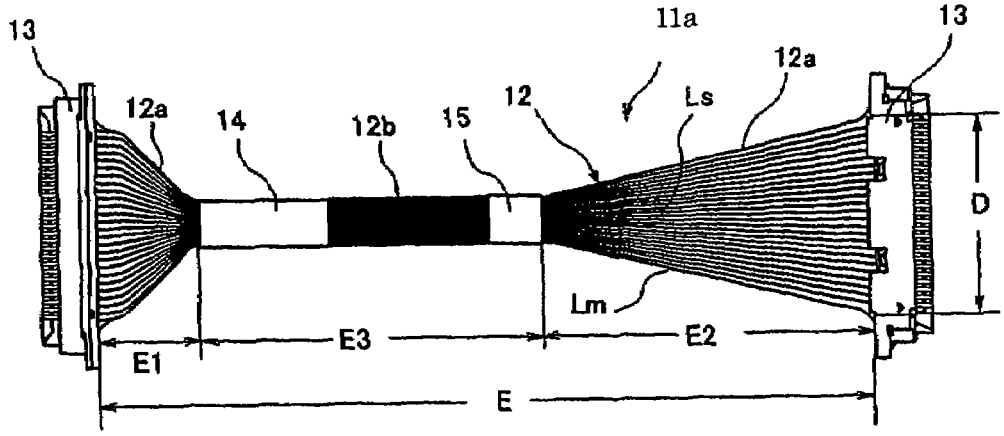
FIG. 1B is a similar view showing a state in which the intermediate portions are bundled.
Figure 2A:
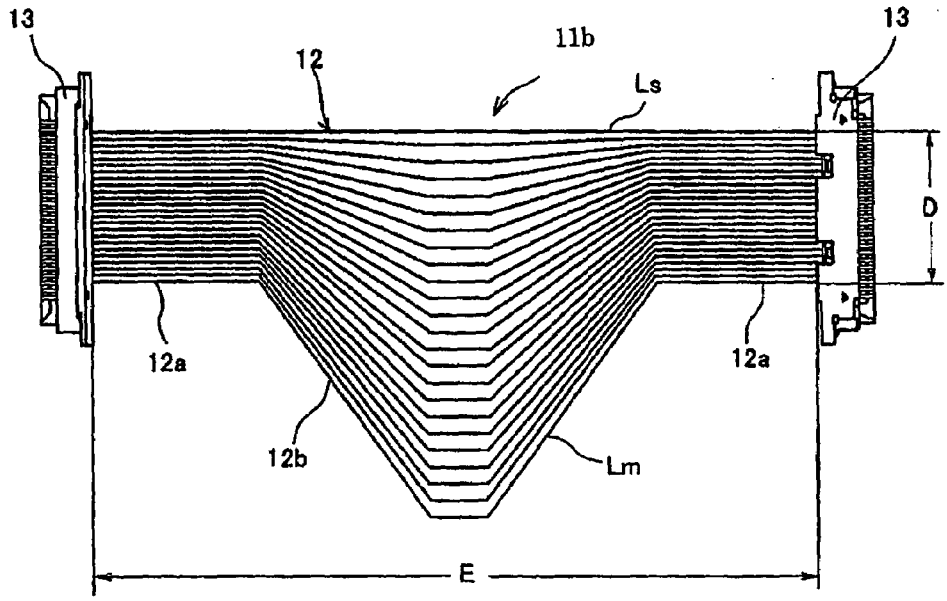
FIG. 2A is a plan view of a multiconductor cable in a second embodiment of the present invention, the view showing a state in which the intermediate portions of the wires constituting the cable are not bundled.
Figure 2B:
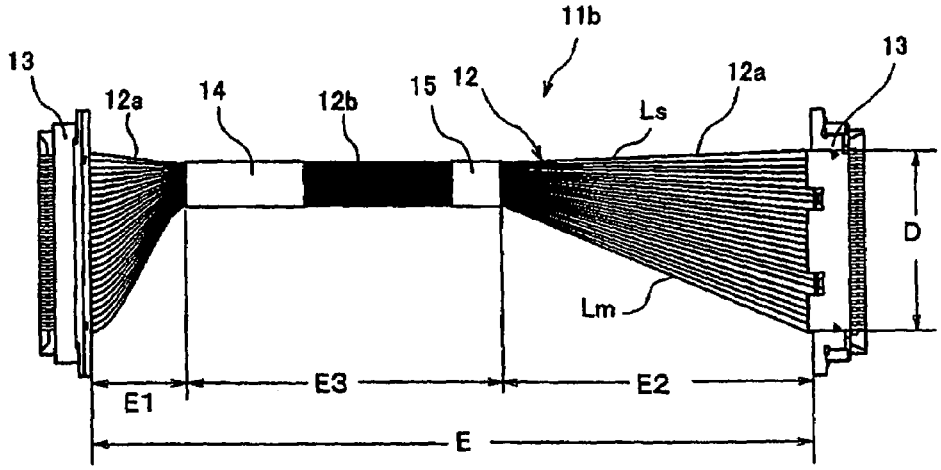
FIG. 2B is a similar view showing a state in which the intermediate portions are bundled.

FIG. 1A is a plan view of a multiconductor cable in a first embodiment of the present invention. FIG. 1A shows a state in which the intermediate portions of the wires constituting the cable are not bundled. FIG. 1B is a similar view showing a state in which the intermediate portions are bundled. FIG. 2A is a plan view of a multiconductor cable in a second embodiment of the present invention. FIG. 2A shows a state in which the intermediate portions of the wires constituting the cable are not bundled. FIG. 2B is a similar view showing a state in which the intermediate portions are bundled.

Multiconductor cables 11*a* and 11*b* are formed by arranging both ends of a plurality of wires 12 in a flat array with a specified pitch and then connecting an electrical connector 13 to each of the ends. It is desirable that the multiconductor cables 11*a* and 11*b* provided with connectors incorporate wires 12 that are single-conductor wires having an overall diameter as relatively small as 1.0 mm or less, for example, and a good flexibility. The single-conductor wire may be an insulated wire, a coaxial conductor, or a shielded wire, for example. The lengths of the individual wires 12 are different from one another successively from the minimum length, Ls, to the maximum length, Lm. The width of the cable at the end is denoted as D, and the distance between the rear ends of the electrical connectors 13 connected to the ends of the cable, i.e., the distance between the ends of the cable is denoted as E.

Before the intermediate portions of the wires constituting the cable are bundled, the multiconductor cables 11*a* and 11*b* are formed such that wires 12 other than the wire having the minimum length Ls have an excess length forming a slack. At the intermediate portion 12*b*, the excess length of the wire increases with increasing distance of the wire from the wire 12 having the minimum length Ls. Therefore, when the wires are arranged in a flat array, the array has a shape that bulges laterally to a large extent.

In the multiconductor cable 11*a* shown in FIGS. 1A and 1B, of the wires, the wire placed at the center of the flat array has the minimum length Ls and wires placed on either side of the central wire increase their excess length as the distance from the central wire increases and, accordingly, extend laterally before the intermediate portions are bundled. When the wires constituting the multiconductor cable 11*a* are bundled at the intermediate portion 12*b*, transforming portions 12*a* decrease the spacing between wires as the position moves from the electrical connector 13 to the intermediate portion 12*b* and, as a result, form an isosceles triangle. The length of one of the transforming portions 12*a* having the shape of an isosceles triangle is denoted as E1, and that of the other as E2. The length of the bundled intermediate portion 12*b* is denoted as E3. Consequently, the equation "E=E1+E2+E3" is established. The distance E has a value nearly equal to the minimum length Ls.

The intermediate portions 12*b* may be bundled by using a bundling member 14, such as an adhesive tape. When shielded wires are used, the wires may be bundled by using a grounding member 15 so that a specific portion can be grounded as required. The shape of the bundled portion has no specific limitations providing that the wires 12 are tied together in a bundle. The bundle may take any shape. A single bundling member 14 may be used to bundle wires at one place with a specific length. A plurality of bundling members may also be used to bundle wires at a plurality of places. Furthermore, the bundled wires 12 may either be tied together tightly or be loosely bound such that their movement is not restricted by one another.

In the multiconductor cable 11*b* shown in FIGS. 2A and 2B, of the wires, the wire placed at one of the outermost positions has the minimum length Ls and the wire placed at the other outermost position, at the opposite side, has the maximum length Lm. In other words, the length of the wire is successively increased from the minimum length Ls at one of the outermost positions of the wire array to the maximum length Lm at the other outermost position. As a result, before the intermediate portions of the wires constituting the cable are bundled, the multiconductor cable 11*b* is formed such that wires 12 other than the wire that is placed at one of the outermost positions and that has the minimum length Ls have an excess length forming a slack. At the intermediate portion 12*b*, the excess length of the wire increases with increasing distance of the wire from the wire that is placed at one of the outermost positions and that has the minimum length Ls. Therefore, when the wires are arranged in a flat array, the array has a shape that bulges largely to one side.

When the wires constituting the multiconductor cable 11*b* are bundled at the intermediate portion, the cable is formed such that transforming portions 12*a* decrease the spacing between wires as the position moves both from the electrical connector 13 to the intermediate portion 12*b* and from one of the outermost positions of the wire array to the other outermost position and, as a result, form a right-angled triangle. The length of one of the transforming portions 12*a* having been transformed into a triangle is denoted as E1, and that of the other as E2. The length of the bundled intermediate portion 12*b* is denoted as E3. Consequently, the equation "E=E1+E2+E3" is established. The method of bundling the wires 12 is the same as that of the first embodiment.

Figure 3A:
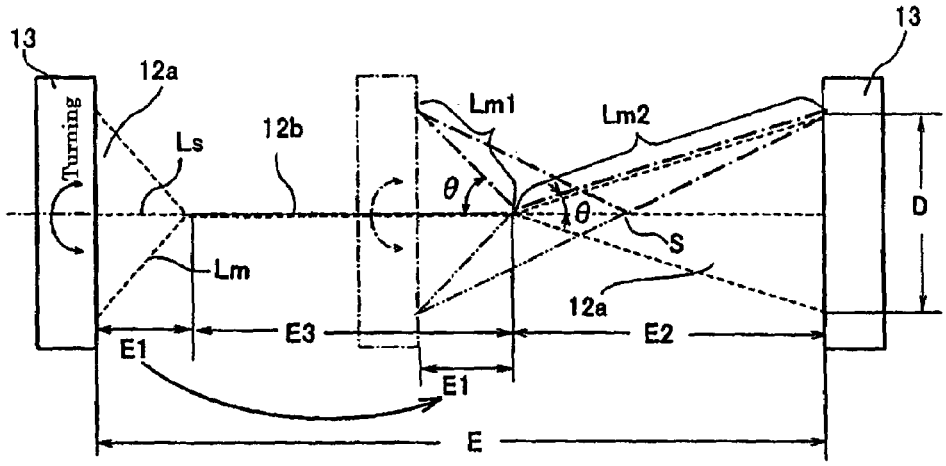
FIG. 3A is a conceptual diagram of the multiconductor cable in the first embodiment of the present invention.
Figure 3B:
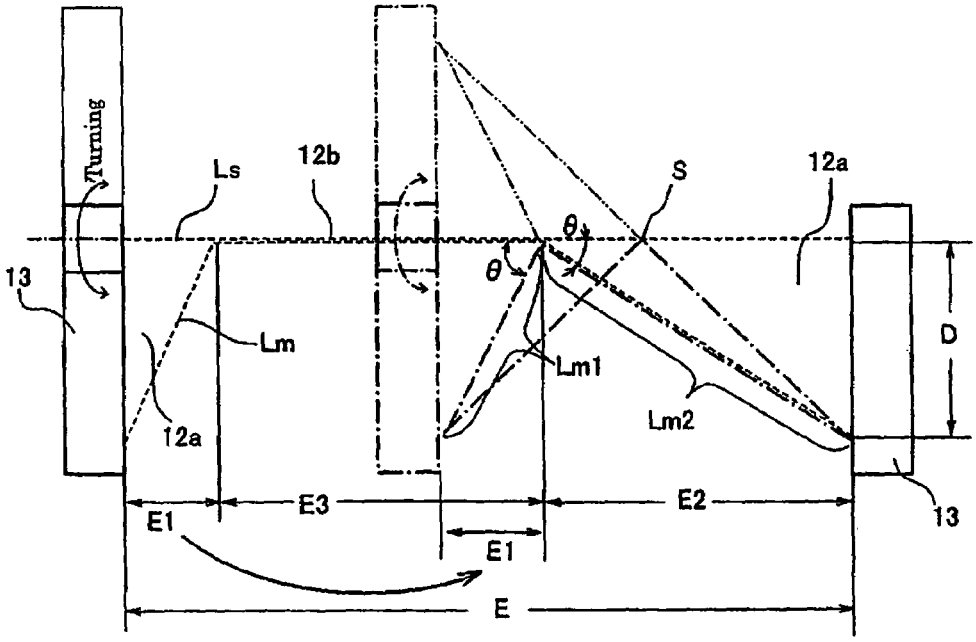
FIG. 3B is a conceptual diagram of the multiconductor cable in the second embodiment of the present invention.

Next, the present invention is explained in detail below by referring to FIGS. 3A and 3B. FIG. 3A is a conceptual diagram of the multiconductor cable in the first embodiment of the present invention, and FIG. 3B is a conceptual diagram of the multiconductor cable in the second embodiment of the present invention. In FIGS. 3A and 3B; the cable width at the end is denoted as D, the distance between the ends is denoted as E, the length of one of the transforming portions is denoted as E1, the length of the other as E2, the length of the bundled portion as E3, the minimum length among the lengths of the wires placed between the ends as Ls, and the maximum length as Lm.

As described earlier, it has been confirmed that in a multiconductor cable, when the distance E is at least six times the width D, the application of twisting due to a turning of 180 degrees or less does not cause a break. Consequently, the present invention deals with a multiconductor cable that has the distance E less than six times the width D and therefore is considered to be prone to break.

In the first embodiment, as shown in FIG. 3A, the wire having the minimum length Ls is placed at the center of the wire array. Therefore, the relation "Ls≈E" is established. On the other hand, the wire having the maximum length Lm is placed at the outermost position of the wire array. The length Lm is expressed as "Lm1+Lm2+E3," where Lm1 is the length of the bent and slanted portion at one of the transforming portions 12*a*, Lm2 is the length of the bent and slanted portion at the other, and E3 is the length of the bundled portion. The difference between the maximum length Lm and the minimum length Ls, i.e., "Lm−Ls," is equal to "Lm1+Lm2−E1−E2."

In other words, when the maximum length Lm is longer than the minimum length Ls by "Lm1+Lm2−E1−E2," the intermediate portions 12*b* can be bundled without elongating the wire placed at the outermost position of the array (because no tension is applied, the wire does not elongate). Here, to simplify the explanation, a case where the formula "E1=E2=½EE" is established is taken up for discussion (in this case, "Lm1+Lm2" becomes the minimum).

In this case, the equation "$Lm-Ls=(E^{2+D2})^{1/2}-E$" can be obtained. In other words, when the difference between the maximum length Lm and the minimum length Ls, i.e., "Lm−Ls," is predetermined in excess of "$(E^2+D^2)^{1/2}-E$," the wire that is placed at the outermost position of the array and that has the maximum length Lm can be bundled along the wire that is placed at the center of the array and that has the minimum length Ls without undergoing tension.

In the second embodiment, as shown in FIG. 3B, the wire having the minimum length Ls is placed at one of the outermost positions of the wire array. Therefore, the relation "Ls≈E" is established. On the other hand, the wire having the maximum length Lm is placed at the other outermost position of the wire array. The length Lm is expressed as "Lm1+Lm2+E3," where Lm1 is the length of the bent and slanted portion at one of the transforming portions 12*a*, Lm2 is the length of the bent and slanted portion at the other, and E3 is the length of the bundled portion. The difference between the maximum length Lm and the minimum length Ls, i.e., "Lm−Ls," is equal to "Lm1+Lm2−E1−E2."

In other words, when the maximum length Lm is longer than the minimum length Ls by "Lm1+Lm2−E1−E2," the intermediate portions 12*b* can be bundled without elongating the wire placed at the other outermost position of the array (because no tension is applied, the wire does not elongate). Here, to simplify the explanation, a case where the formula "E1=E2=½E" is established is taken up for discussion (in this case, "Lm1+Lm2" becomes the minimum).

In this case, the equation "$Lm-Ls=(E^2+4D^2)^{1/2}-E$" can be obtained. In other words, when the difference between the maximum length Lm and the minimum length Ls, i.e., "Lm−

Ls," is predetermined in excess of "$(E^2+4D^2)^{1/2}-E$," the wire that is placed at the other outermost position of the array and that has the maximum length Lm can be bundled along the wire that is placed at the opposite outermost position of the array and that has the minimum length Ls without undergoing tension.

In addition, according to practical experience, it is desirable that the wire that is placed at the outermost position of the array and that has the maximum length Lm be formed to have an angle, θ, of less than 45 degrees, where the angle θ is an angle produced by a wire placed from the end to the bundled intermediate portion and the center axis of the bundled intermediate portion (see FIGS. 3A and 3B about the angle θ). In this case, in the first embodiment, the relation "D<E" can be achieved. Consequently, the relation "$Lm-Ls>D(2^{1/2}-1)\approx 0.41D$" can be achieved. On the other hand, in the second embodiment, the relation "2D<E" can be achieved. Consequently, the relation "$Lm-Ls>2D(2^{1/2}-1)\approx 0.83D$" can be achieved.

As described above, of the various embodiments, the embodiment that can minimize the value of "Lm−Ls," which is the difference between the maximum length Lm and the minimum length Ls, is the first embodiment under the condition that the two lengths of the bent and slanted portions at both transforming portions 12*a* are set to be equal (Lm1=Lm2, or E1=E2). In this case, "Lm−Ls" becomes "$(E^2+D^2)^{1/2}-E$." Therefore, the multiconductor cable is required to satisfy the following formulae:

$$D/E>1/6, \text{ and } (Lm-Ls)>\{(D^2+E^2)^{1/2}E\},$$

where D is the width at both ends of the cable, E is the distance between the ends of the cable, Lm is the maximum length, and Ls is the minimum length. In this case, when the angle, θ, produced by a wire placed from the end to the intermediate portion 12*b* and the center axis of the intermediate portion 12*b* is predetermined to be less than 45 degrees, the relation "Lm−Ls>0.41D" can be realized.

Figure 7:
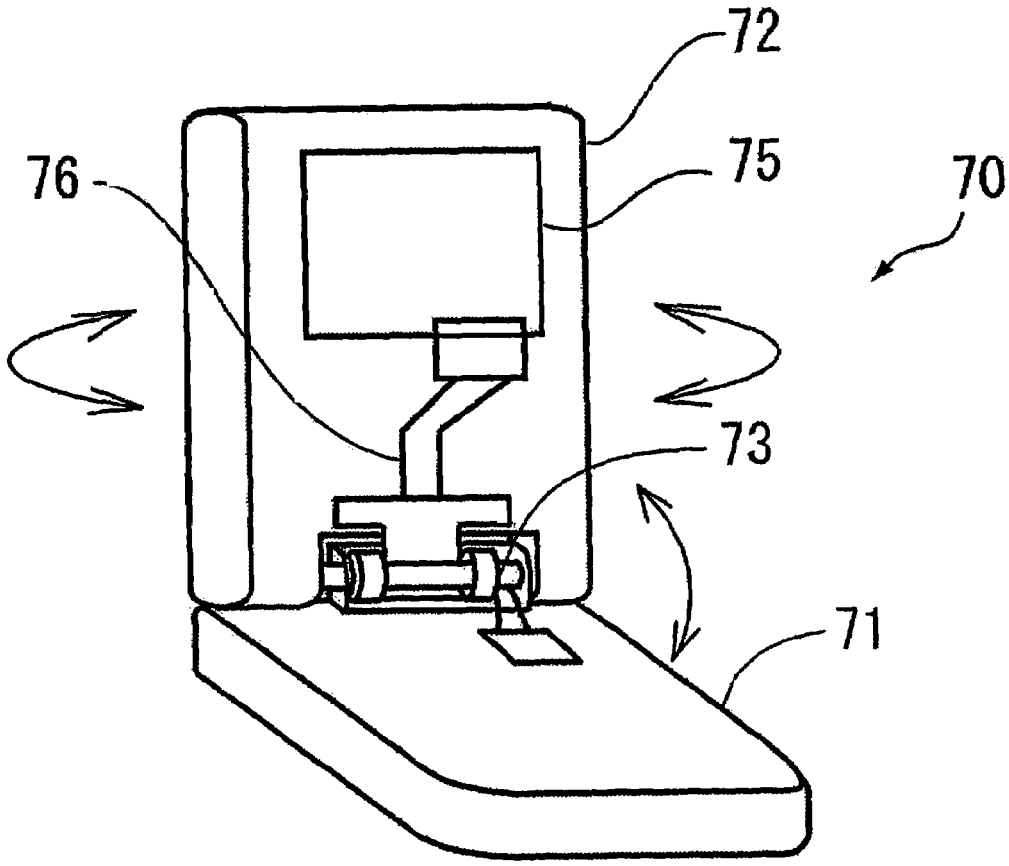
FIG. 7 is a perspective view illustrating an embodiment of an information device of the present invention.

FIG. 7 is a perspective view illustrating an embodiment of an information device of the present invention. A cellular mobile phone 70 has a main body 71 and a display 72, which are connected with each other by a hinge 73. The main body 71 houses a main board (not shown), and the display 72 is provided with a liquid crystal panel 75. The main board and the liquid crystal panel 76 are linked with each other by a multiconductor cable 76 passing through the portion of the hinge 73.

When a multiconductor cable having the above-described structure is used for the wiring through a turning portion such as the connection between a main board and a liquid crystal display of a cellular mobile phone, a notebook-size computer, a video camera, and the like, it is used at a place where it undergoes twisting with a twisting angle of 90 to 180 degrees (80 to 190 degrees when a margin is considered). In addition, because a plurality of wires are bundled together and the bundled portion as a whole is thick to a certain extent, when the wires are bent, the central position may deviate. Consequently, it is difficult to maintain the value of "Lm−Ls" at the calculated value. Therefore, it is necessary to predetermine the value of "Lm−Ls," which is the difference between the maximum length Lm and the minimum length Ls, with a certain margin.

However, when the value of "Lm−Ls" is increased more than necessary, the excess length at the bundled intermediate portion increases excessively and may produces a slack. When this happens, the total appearance becomes unsightly and bending, buckling, and breaking tend to occur. As explained by referring to FIGS. 3A and 3B, of the various embodiments, the embodiment that maximizes the value of "Lm−Ls," which is the difference between the maximum length Lm and the minimum length Ls, is the embodiment under the condition that the bundling is performed by using as the reference the wire that is placed at one of the outermost positions of the wire array and that has the minimum length Ls as explained by referring to FIG. 3B. In this case, "Lm−Ls" is expressed as "$(E^{2+}4D^2)^{1/2}-E$." In this case, when the angle, θ, produced by a wire placed from the end to the bundled intermediate portion and the center axis of the bundled intermediate portion is predetermined to be less than 45 degrees, the relation "Lm−Ls>0.83D" can be realized. Various verification tests for accomplishing the present invention revealed that when the value of "Lm−Ls" is at most three times the estimated value, the buckling and breaking can be suppressed. In other words, it is desirable that the cable satisfy the following formulae:

$$\theta<45 \text{ degrees, and } (Lm-Ls)<3\times\{2D(2^{1/2}-1)\}\approx 2.5D,$$

where θ is the angle produced by a wire' portion from one of the ends to the intermediate portion and the same wire' portion in the intermediate portion, Lm is the maximum length, and Ls is the minimum length.

Figure 4:
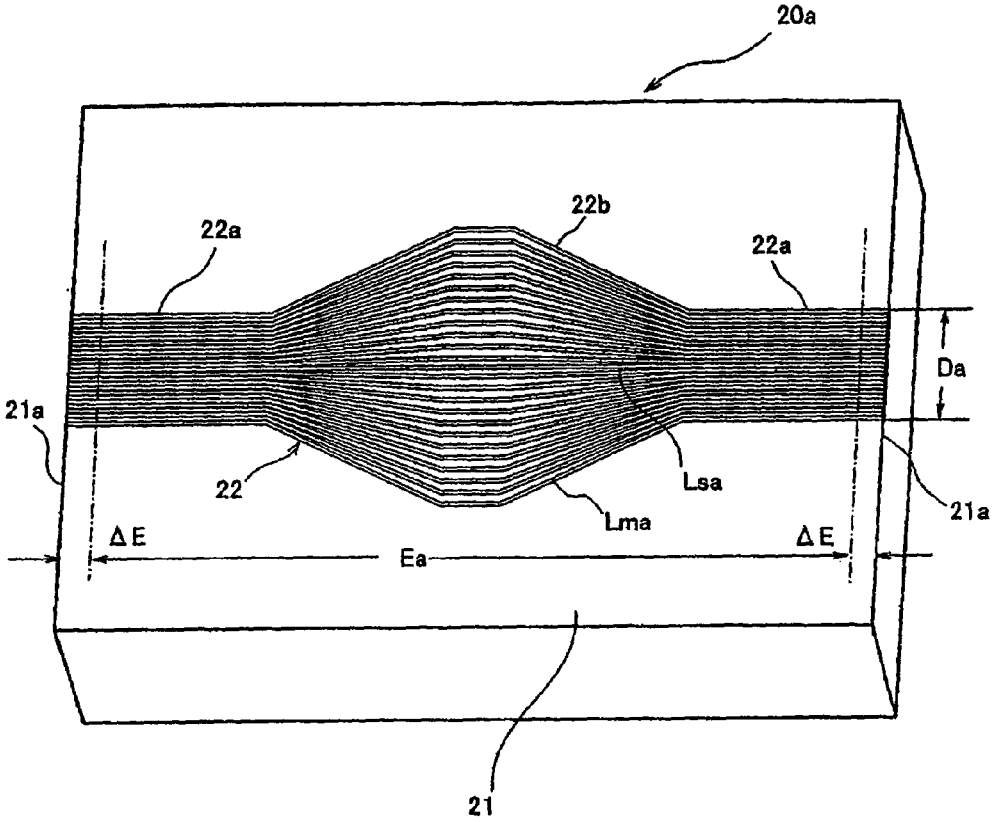
FIG. 4 is a perspective view of an example of an arranging tool for producing a multiconductor cable in the first embodiment of the present invention.
Figure 5:
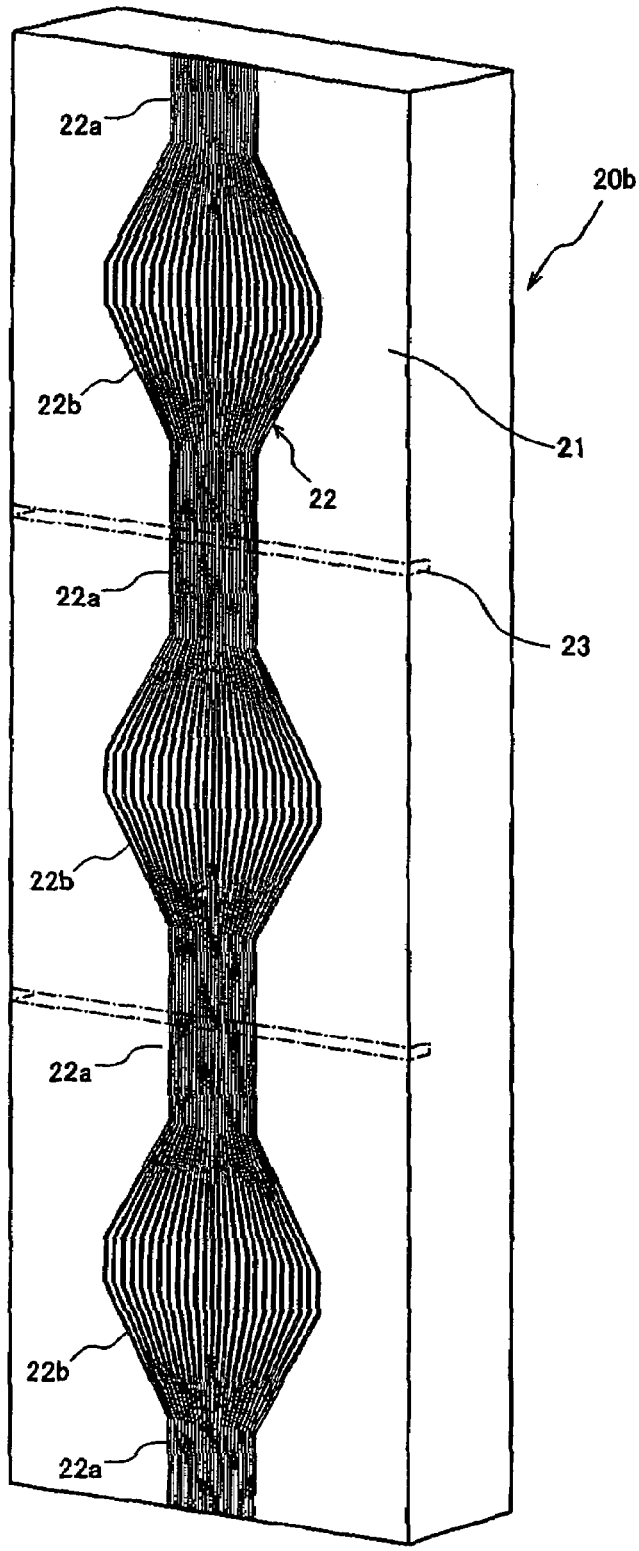
Figure 6A:
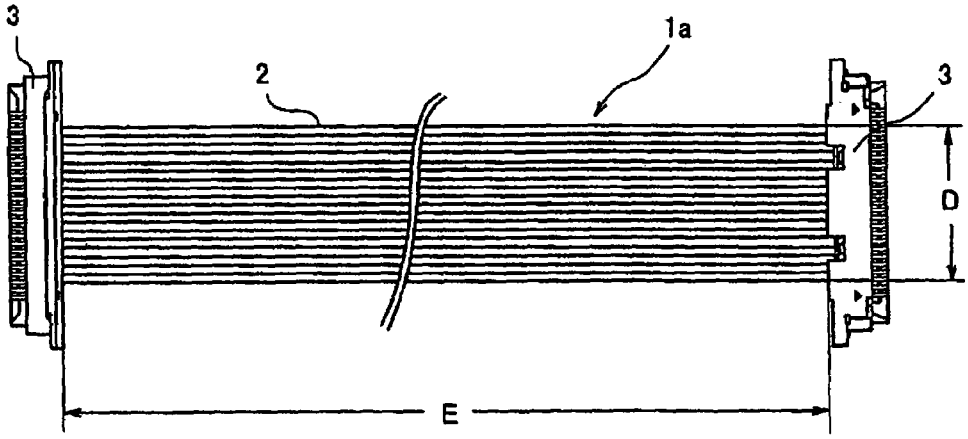
FIG. 6 A Prior art
FIG. 6A is a plan view of an example of the conventional multiconductor cable.
Figure 6B:
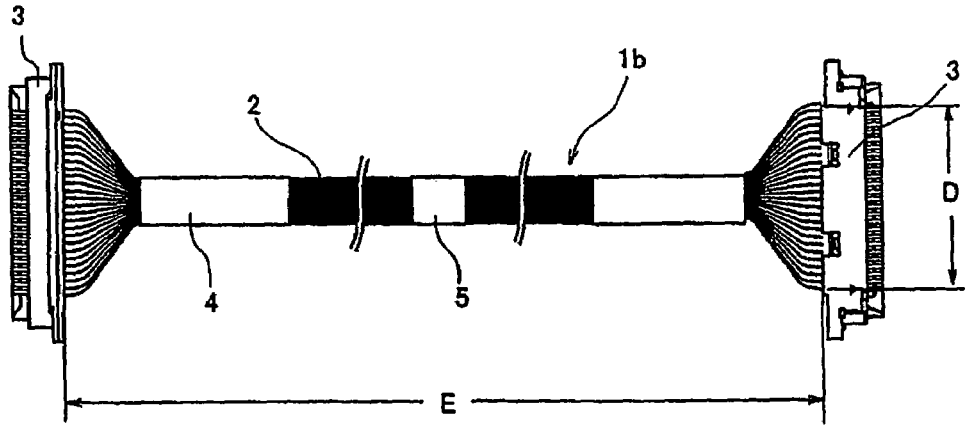
FIG. 6 B Prior art
FIG. 6B is a plan view of another example of the conventional multiconductor cable.

FIG. 4 is a perspective view of an example of an arranging tool for producing a multiconductor cable in the first embodiment of the present invention (this example is for producing one cable at a time). FIG. 5 is a perspective view of another example of an arranging tool for producing a multiconductor cable in the first embodiment of the present invention (this example is for producing a plurality of cables at a time).

FIG. 4 shows an arranging tool 20*a*, which is formed as a block having the shape of a rectangular parallelepiped, having a flat arranging face 21. The arranging face 21 is provided with a plurality of wire-holding grooves 22 having different lengths. The wire-holding grooves 22 have a cross section of a V or U shape. The groove has such a depth that when a wire is held in the groove, the top of the wire is flush with the surface of the arranging face 21 or slightly above it.

In the wire-holding grooves 22, a transforming-portion-arranging section 22*a* is formed at both sides such that the section has grooves parallel with one another with a pitch according to the wire-arranging pitch at the ends of the multiconductor cable to be produced. An intermediate-portion-arranging section 22*b* is formed in the following way. The shortest linear groove at the center has a minimum length of Lsa. The outermost grooves have a maximum length of Lma. The grooves increase their length successively as their position moves from the center to the outside, so that they are bent with an angular shape or a curved shape. A plurality of wires are placed on the arranging face 21 of the arranging tool 20*a*, and they are squeezed into the wire-holding grooves 22 by using a spatula or a similar tool so that they can be arranged.

Subsequently, an adhesive tape or a similar member is attached onto at least the transforming-portion-arranging sections 22*a* at both sides, so that the wires held in the wire-holding grooves 22 are fixed so as to maintain the arranged state. The adhesive tape may be made of polyethylene or other plastic on which adhesive is applied. Then, both ends of the wires are neatly aligned along an edge 21*a* of the arranging tool 20*a* by cutting or another method. The wires maintained in the arranged state are removed from the arranging tool 20*a*. An electrical connector or another terminating member is connected to both ends of the wires, as shown in FIG. 1A. The intermediate portions of the wires are bundled to form a multiconductor cable, as shown in FIG. 1B.

In addition, the transforming-portion-arranging section 22*a* of the arranging tool 20*a* has an arranging width, Da, which is nearly the same as the cable width D shown in FIG. 1A. The length at both ends of the wire-holding grooves 22 for connecting the electrical connector or another terminating member is denoted as ΔE. The wire-holding-groove-forming portion has an effective length, Ea, which is obtained by excluding the length ΔE. The effective length Ea is predetermined to be the same as the distance E shown in FIG. 1A. In this case, it is desirable that the wire-holding-groove-forming portion of the arranging tool satisfy the following formulae:

$$Da/Ea>1/6, \text{ and } (Lma-Lsa)>\{(Da^2+Ea^2)^{1/2}-Ea\},$$

where Da is the arranging width at the transforming-portion-arranging section, and Ea is the effective length of the wire-holding-groove-forming portion.

FIG. 5 shows an arranging tool 20*b* in which a plurality of wire-holding-groove-forming portions each for forming one multiconductor cable are connected in tandem. This tool can produce a plurality of multiconductor cables concurrently. The arranging tool 20*b* has an arranging face 21 on which the following two members are formed alternately: one is an transforming-portion-arranging section 22*a* for arranging the transforming portion of a multiconductor cable, and the other is an intermediate-portion-arranging section 22*b* for arranging the intermediate portion at which the wires are bundled (both members have a structure similar to those formed in the arranging tool 20*a*). This structure enables concurrent wire arranging for a plurality of multiconductor cables. When a cut groove 23 or another similar means is provided in the portion for the transforming-portion-arranging section 22*a*, individual multiconductor cables can be easily separated after the wires are held in the wire-holding grooves 22 and subsequently maintained at the arranging state by attaching an adhesive tape or a similar member.

When the above-described arranging tool is used to produce a multiconductor cable provided with connectors, a plurality of wires placed between the ends can be easily arranged by automatically setting the individually different lengths successively from the minimum length to the maximum length. As a result, the cable can be produced with uniform quality and at a low cost without relying on the skill of the workers. FIGS. 4 and 5 show examples of arranging tools for producing the multiconductor cable having the shape shown in FIGS. 1A and 1B. Nevertheless, the multiconductor cable having the shape shown in FIGS. 2A and 2B can also be produced by using a similar arranging tool with uniform quality and at a low cost.

According to the present invention, even though a multiconductor cable has a small total length, the intermediate portions of the wires constituting the cable can be bundled together effectively. Therefore, the present invention enables the achievement of a miniaturized multiconductor cable.

The present invention is described above in connection with what is presently considered to be the most practical and preferred embodiments. However, the invention is not limited to the disclosed embodiments, but, on the contrary, is intended to cover various modifications and equivalent arrangements included within the spirit and scope of the appended claims.

The entire disclosure of Japanese patent application 2004-046375 filed on Feb. 23, 2004 including the specification, claims, drawing, and summary is incorporated herein by reference in its entirety.

What is claimed is:

1. A method of producing at least one multiconductor cable that comprises a plurality of wires having an intermediate portion and transforming portions located between each of the ends of the cable and the ends of the intermediate portion, the method comprising the steps of:

(a) preparing an arranging tool having a flat arranging surface provided with at least one wire-holding-groove-forming portion having a plurality of wire-holding grooves arranged in a flat array on the flat arranging surface with different lengths from a minimum length of Lsa to a maximum length of Lma, the lengths being varied successively; the at least one wire-holding-groove-forming portion being provided with an intermediate-portion arranging section having grooves with different lengths varying successively and transforming-portion-arranging sections having grooves parallel with one another and locating at both ends of the intermediate-portion-arranging section;

(b) placing a plurality of wires into the wire-holding grooves;

(c) attaching an adhesive tape or a member having a similar function to the transforming portions of the wires so that the arranged state can be maintained;

(d) removing the wires from the arranging tool with maintaining the arranged state;

(e) forming a terminal structure in which the plurality of wires are arranged in a specific pitch for electrical connection at both ends of the wires; and (f) bundling the intermediate portions of the wires together.

2. A method of producing at least one multiconductor cable as defined by claim 1, wherein the at least one wire-holding-groove-forming portion in the arranging tool satisfies the formulae $$Da/Ea>1/6, \text{ and } (Lma-Lsa)>\{(Da^2+Ea^2)^{1/2}-Ea\},$$

where Da is the arranging width of the transforming-portion-arranging section, and Ea is the effective length of the at least one wire-holding-groove-forming portion.

3. A method of producing at least one multiconductor cable as defined by claim 1 or 2, wherein the at least one wire-holding-groove-forming portion in the arranging tool is at least two wire-holding-groove-forming portions connected in tandem, each of the wire-holding-groove-forming portions being provided for forming one multiconductor cable.

* * * * *